US006745821B1

(12) United States Patent
Wilson

(10) Patent No.: US 6,745,821 B1
(45) Date of Patent: Jun. 8, 2004

(54) HOT SPRUE SYSTEM FOR DIECASTING

(75) Inventor: Graham Louis Wilson, Moorabbin (AU)

(73) Assignee: Hotflo Diecasting Pty Ltd., Victoria (AU)

( * ) Notice: Subject to any disclaimer, the term of this patent is extended or adjusted under 35 U.S.C. 154(b) by 0 days.

(21) Appl. No.: 10/069,393

(22) PCT Filed: Aug. 24, 2000

(86) PCT No.: PCT/AU00/01002

§ 371 (c)(1),
(2), (4) Date: Feb. 26, 2002

(87) PCT Pub. No.: WO01/19552

PCT Pub. Date: Mar. 22, 2001

(30) Foreign Application Priority Data

Sep. 16, 1999 (AU) ..... PQ2907

(51) Int. Cl.[7] ..... B22D 17/02; B22D 35/06
(52) U.S. Cl. ..... 164/342; 164/312; 164/348
(58) Field of Search ..... 164/137, 342, 164/133, 316, 113, 312, 348; 425/549, 568

(56) References Cited

U.S. PATENT DOCUMENTS

| | | | | |
|---|---|---|---|---|
| 3,137,904 A | * | 6/1964 | Steinman et al. | 164/342 |
| 3,399,428 A | * | 9/1968 | Valyi | 425/195 |
| 3,677,682 A | * | 7/1972 | Putkowski | 425/192 R |
| 3,791,440 A | * | 2/1974 | Cross | 164/113 |
| 4,304,544 A | | 12/1981 | Crandell | 425/549 |
| 4,638,849 A | * | 1/1987 | Whitehorn | 164/311 |
| 4,795,126 A | | 1/1989 | Crandell | 249/78 |
| 5,203,397 A | | 4/1993 | Bandyopadhyay | 164/309 |
| 5,315,686 A | | 5/1994 | Caugherty et al. | 392/480 |
| 5,379,827 A | * | 1/1995 | Perrella et al. | 164/343 |

FOREIGN PATENT DOCUMENTS

GB 2255738 A 11/1992 ..... B22D/17/30

OTHER PUBLICATIONS

Goodwin, Frank E. "Development of Direct Injection Zinc Die Casting Technology in Japan." 15th DieCasting Congress & Exposition, Oct. 16–19, 1989, St. Louis, MO. Paper No. G–T89–092. pp. 1–6.

Groeneveld, T.P. et al. "Commercial Application of the Heated–Manifold Direct–Injection System for Zinc Die Casting." SDCE 13th International Die Casting Congress and Exposition, Jun. 3–6, 1985, Milwakee, WI. Paper No. G–T85–051. pp. 1–6.

Groeneveld, Thomas P. et al. "Heated–Manifold, Direct–Injection System for Zinc Die Casting." 12th International Die Casting Congress and Exposition, Oct. 31–Nov. 3, 1983, Minneapolis, MN. Paper No. G–T83–066. pp. 1–5.

* cited by examiner

*Primary Examiner*—Kiley Stoner
*Assistant Examiner*—Kevin P. Kerns
(74) *Attorney, Agent, or Firm*—Sidley Austin Brown & Wood LLP

(57) ABSTRACT

A sprue insert-set which substantially eliminates sprue castings and improves melt-flow in high-pressure hot-chamber diecasting. The insert-set consists of (i) a heated sprue body insert for mounting in the fixed dieblock of a die set and (ii) a cooled sprue tip insert for mounting in the moving dieblock of the die set. The body and tip inserts are mounted so that their inner ends mate with one another in the region of the die parting-line to conjointly form a curved transition channel that connects the sprue channel in the body insert with a runner channel formed along the parting-line of the die set. The temperatures of the body insert and the top insert can be controlled so that the freeze-point occurs in the transition channel and the melt in the sprue channel is able to run back into the machine nozzle at the end each shot, thereby eliminating sprue castings.

7 Claims, 7 Drawing Sheets

HOT SPRUE SYSTEM FOR DIECASTING

TECHNICAL FIELD

This invention relates to high-pressure diecasting methods and apparatus, and more particularly, to hot sprue systems for use with hot-chamber, high-pressure diecasting.

BACKGROUND TO THE INVENTION

There is a very large installed base of hot-chamber, high-pressure, diecasting machines dedicated to the production of small die-cast products of zinc, lead, tin magnesium, aluminum and their alloys. FIG. 1 shows a typical machine 10 of this type. A pool of molten metal 12 is held in a heated pot 14 from which 'shots' of melt are forced, by a plunger 16 working in a submerged cylinder 18, through a gooseneck 20 and an externally flame-heated connecting nozzle 22, into a cavity 24 formed between a fixed die 26 and a moving die 28. Fixed die 26 is mounted on a fixed platen 30 and moving die 28 is mounted on a moving platen 32 that is pressed toward the fixed platen by the piston 34 of a hydraulic or pneumatic ram, the clamping force being taken by tie-rods 36. When dies 26 and 28 are closed, plunger 16 is driven downwards into cylinder 18 by the piston 38 of a pneumatic ram 40 to force a shot of melt into cavity 24 and to hold the pressure until it has frozen. After which, plunger 16 is raised to suck the remaining liquid melt from nozzle 22 and gooseneck 20 back into melt pool 12. To assist the flowback of melt at the end of a shot, nozzle 22 normally slopes upward to fixed die 26. Indeed, for the same purpose, the whole press portion of the machine (comprising the dies and platens) can be tilted slightly downward towards nozzle 22.

At the commencement of a shot, the melt is conveyed from heated nozzle 22 through a sprue bush 42 fitted in the back of fixed die 26 and through a sprue channel 44, formed in the fixed die 26, to the interface or parting-line 46 of dies 26 and 28. It is then conveyed along the interface 46 by one or more runner channels 48, through a gate orifice 49, into cavity 24. As the injection pressure in such machines is commonly between 10 and 30 mPa, nozzle 22 must be pressed hard against sprue bush 42 and gooseneck 20 to avoid leakage. The use of sprue bush 42 assists in forming the seal at the die end of nozzle 22 and it has the advantage that it can be easily replaced should a freeze-plug form therein after a shot.

Sprue channel 44 is strongly tapered so that it widens toward die interface 46 from sprue bush 42 in the direction of melt flow. It is of such a volume that the freeze-point will occur in sprue channel 44 inwards or down-stream of bush 42 at the end of a shot. On the other hand, the runner channel(s) generally narrow(s) in the direction of melt flow (i.e., towards gate 49) so that the melt is accelerated and enters the cavity at high velocity. This common arrangement of sprue and runner channels allows the cast sprue and runner(s) to be easily removed from the dies, together with the attached products, as one piece after the dies have opened. Each runner channel 48 is normally connected to its respective cavity 24 via narrow slot-like gate 49 so as to form a thin and easily broken connection between the product casting and it's attached runner and sprue castings.

It will be appreciated from the above that, in this specification, the sprue and runner channels form a melt path within the dies that conveys the melt to the cavity gate(s). The sprue channel conveys the melt from the exterior (normally the back) of the fixed die to the front face—or parting-line—of the fixed-die, while each runner conveys the melt from the sprue channel to the respective cavity gate along the interface between the fixed and moving dies. The sprue and runner castings are the die-cast metal that solidifies in the sprue and runner channels (respectively) at the end of a shot.

Though hot-chamber diecasting is very common, relatively trouble-free and can produce high quality product at high production rates, a major disadvantage of the technique is the large amount of metal contained in the sprue and runner castings compared with the metal in the product. After detachment from the products, the sprue and runner castings are generally remelted and reused, but this represents high-energy losses and causes melt contamination. Another significant disadvantage of conventional hot-chamber diecasting is the abrupt discontinuity in both section and direction in the melt path between the wide and widening sprue channel and the narrow and narrowing runner channel(s); a discontinuity which leads to turbulent and inefficient melt flow.

It will be appreciated that hot-chamber diecasting is a similar process to the injection moulding of plastics materials. While both can pump shots of melt into cavities via sprue and runner systems, losses associated with the sprue and runner castings are much less with injection moulding. In injection moulding, it is common to employ electrically heated sprue-channels (often called 'nozzles' in the injection moulding context), or electrically heated cores (called 'hot-tips') within the sprue-channels, to eliminate the generation of sprues. Indeed, if such a device is used to inject molten plastic directly into a cavity, both runners and sprues can be eliminated. It is even possible to use a mechanical valve in the sprue nozzle or hot-tip to close the channel at the entrance to the cavity so that the molten plastic feed-line can be kept pressurized between shots, allowing very high production rates.

While it has been suggested from time to time (see for example U.S. Pat. Nos. 4,304,544 and 4,795,126 to Crandell) that heated nozzles and hot-tips designed for injection moulding can be used for direct-injection diecasting, this has proved impractical. The much higher melting point, thermal conductivity and electrical conductivity of metals relative to plastics have made direct-injection diecasting problematic.

The most notable attempt at direct-injection in hot-chamber diecasting known to the applicant is that undertaken by the Battelle Columbus Laboratories for the International Lead Zinc Research Organization [ILZRO] during most of the 1980s. A large number of progress reports were prepared and published on this work by ILZRO or Battelle. An early such report was published in a paper (No. G-T83-066) entitled "Heated Manifold, Direct-Injection System for Zinc Diecasting" by Groeneveld and Kaiser of Battelle and Herrschaft of ILZRO at the International Diecasting Congress and Exposition, Minneapolis, Oct. 31 to Nov. 3, 1983. A further progress report, entitled "Commercial Application of the Heated-Manifold Direct-Injection System of Zinc Diecasting" was published in a paper at the Exposition of Jun. 3–6 1985 in Milwaukee, Wiss., with Groeneveld of Battelle as primary author. A further progress report (No. 30) on the ILZRO direct-injection project (authored by Groeneveld) was published by in March 1988, noting that "several million castings have been made by direct injection". Production rates and product quality were reported to be at least equal to conventional diecasting using runners and sprues.

Despite the obvious and great benefits offered by direct-injection diecasting, the technique disclosed in the above publications (particularly, the Battelle work) has not been widely applied by the diecasting industry. The principal reason for this appears to be that die and 'nozzle' design methods for direct injection have not been developed to anywhere near the same facility and reliability as die, runner and sprue design techniques for conventional hot-chamber diecasting. Consequently, a great deal of highly-expert and highly-expensive experimentation must be undertaken before any given product, cavity, die, machine and 'nozzle' combination can be made to work satisfactorily. Furthermore, direct-injection in multi-cavity dies involves major changes to existing diecasting machines with respect to metal flow and control, making machine set-up and tool-changing lengthy processes. In short, implementation of direct-injection diecasting appears to be beyond the technical ability as well as the financial capacity of the great majority of hot-chamber die-casters.

OUTLINE OF INVENTION

The present invention is based upon the realization that a significant part of the benefit offered by direct-injection diecasting can be achieved with very little change to current die design and no change to hot-chamber machine layout, if a heated sprue channel is employed with a substantially conventional runner channel and if a curved transition channel connects the sprue channel to the runner channel. The temperature of the sprue channel can be controlled to ensure that the melt can run back from the sprue channel after each shot, while the temperature of the transition channel can be arranged so that the freeze-point occurs therein. If the die parting-line includes the transition channel, the casting formed therein (integral with the runner casting) can be ejected with the runner casting in the normal manner. The use of separate mating die inserts to define the transition channel enables the temperature of that channel to be controlled independently of the sprue insert and die temperature. One of the die inserts is preferably a heated sprue body insert in the fixed die, while the other is preferably an opposing, mating and cooled sprue Up insert in the moving die.

Such a 'sprueless' diecasting technique can avoid the production, recovery and remelting of sprues (and so achieve most of the savings of direct-injection) with minimal change to die design, no change to machine layout and without any need for troublesome valved injection nozzles. Furthermore, the use of a hot-sprue die-insert allows the melt flow-path within the die to be optimized for streamlined flow without the need for any abrupt change of section. Indeed, gradual and uniform tapering of the melt path is readily achieved from the sprue inlet to the gate so that the melt is constantly and smoothly accelerated. The need for a reverse taper on the sprue channel to permit withdrawal of a sprue casting is, of course, eliminated.

It will be normal for the sprue channel to extend roughly horizontally in the fixed die so as to be orthogonal to the die parting-line and the back of the fixed die (as is conventional) and for the transition channel to be a smooth curve that subtends an angle of about 90° from the sprue channel to the runner channel. However, the sprue and/or the die parting-line may be oriented so that the angle subtended by the curve of the transition channel is other than 90°, though this will be unusual. As already noted, the transition channel can be made to decrease (taper) in cross-section in a smooth and uniform manner so that the melt is accelerated as it flows around the curve to enter the runner channel.

It is preferable that the insert in the moving die that defines portion of the transition channel has its own cooling means (such as provision for coolant circulation) so that its temperature can be adjusted independently of the rest of the moving die so as to ensure that freeze-off occurs in the transition channel. For this purpose, it is desirable for the insert to include temperature sensor means so that automatic regulation can be effected. Similarly, it is desirable for the sprue-insert in the fixed die to include temperature sensor means so that it can be kept at a sufficiently high temperature to ensure flowback of the melt after a shot.

It will be appreciated that mating die inserts like those required to define the transition channel are familiar to average diecasting toolmakers and that the setting of appropriate temperatures for the sprue and transition channels to achieve appropriate flowback and freeze-off (respectively) are well within the competency of average machine operators. Apart from the need for the die inserts, tool design and machine operation normally will be unaffected by the method of the present invention. Normal cavity inserts and ejection mechanisms can be used. Where there is more than one cavity in a die-set branching or radiating transition channels can be formed in the inserts to connect the sprue channel to the various runner channels.

It will be seen that the present invention relates to diecasting methods, diecasting apparatus and to die-inserts for use in diecasting.

DESCRIPTION OF EXAMPLES

Having portrayed the nature of the present invention, two examples will now be described with reference to the accompanying drawings. However, those skilled in the art will appreciate that many variations and modifications can be made to the chosen examples without departing from the scope of the invention as defined by the following claims.

BRIEF DESCRIPTION OF THE DRAWINGS

FIGS. 2–4 show portion of a conventional diecasting machine 100 in which the die-set 102 is shown closed and mounted between a fixed platen 104 and a moving platen 106. Die-set 102 comprises a fixed backplate 108 secured to fixed platen 104 (with an insulating plate 109 placed there between) and a moving backplate 110 fixed to moving platen 106. A fixed dieblock 112 is secured to fixed backplate 108 and a moving dieblock 114 is secured to moving backplate 110. The interface or parting plane between dieblocks 112 and 114 is shown at 115. A bolster 116 is secured to each side of moving backplate 110 so as to transfer the force of moving platen 106 to moving dieblock 114 around an ejector assembly 118, which comprises a pair of ejector plates 1 20a and 1 20b that capture the heads of a set of four product ejector pins 122 and a single runner ejection pin 124.

Figure 1:
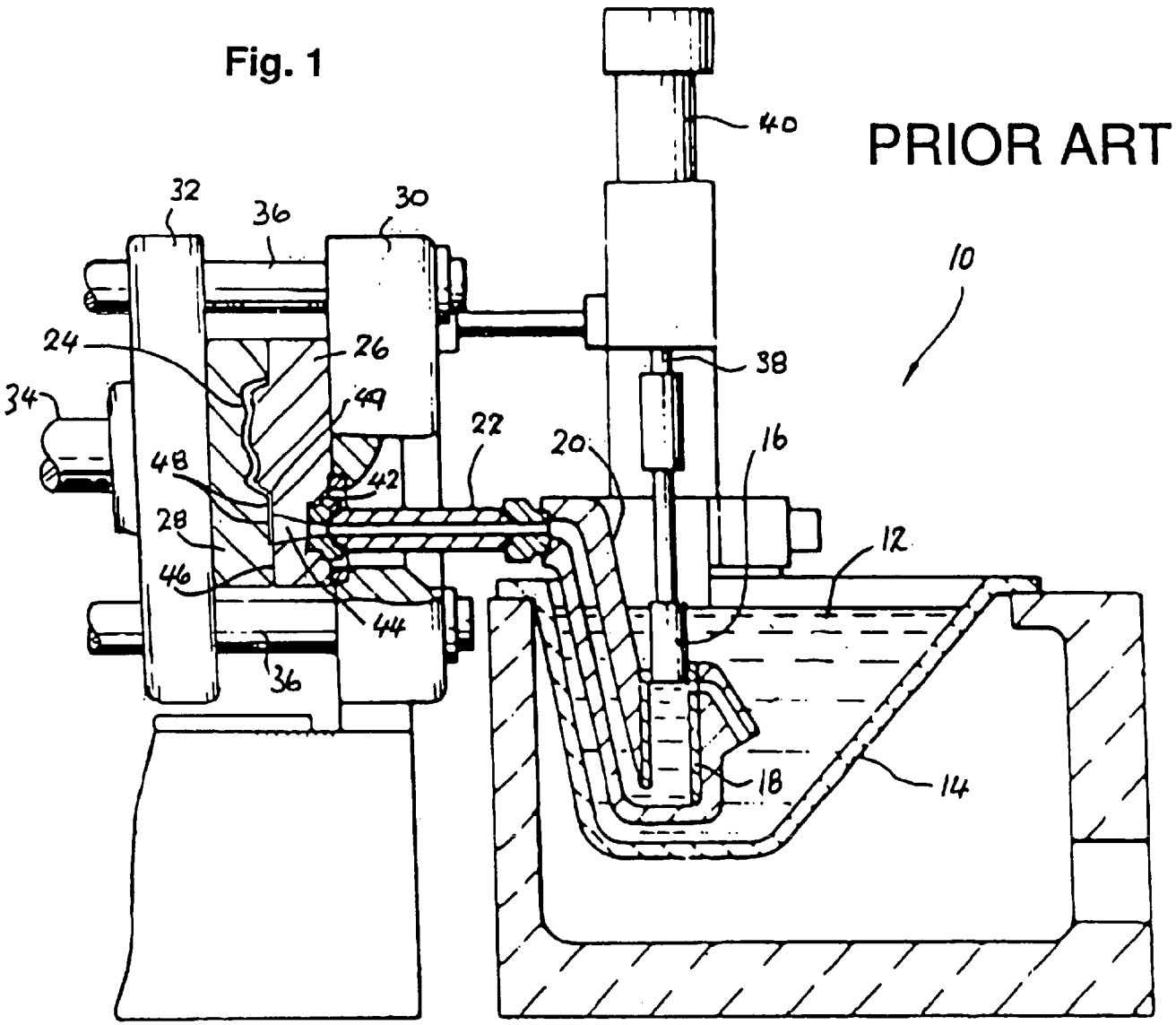
FIG. 1 is a part-sectional elevation of a typical prior art hot-chamber diecasting machine.
Figure 2:
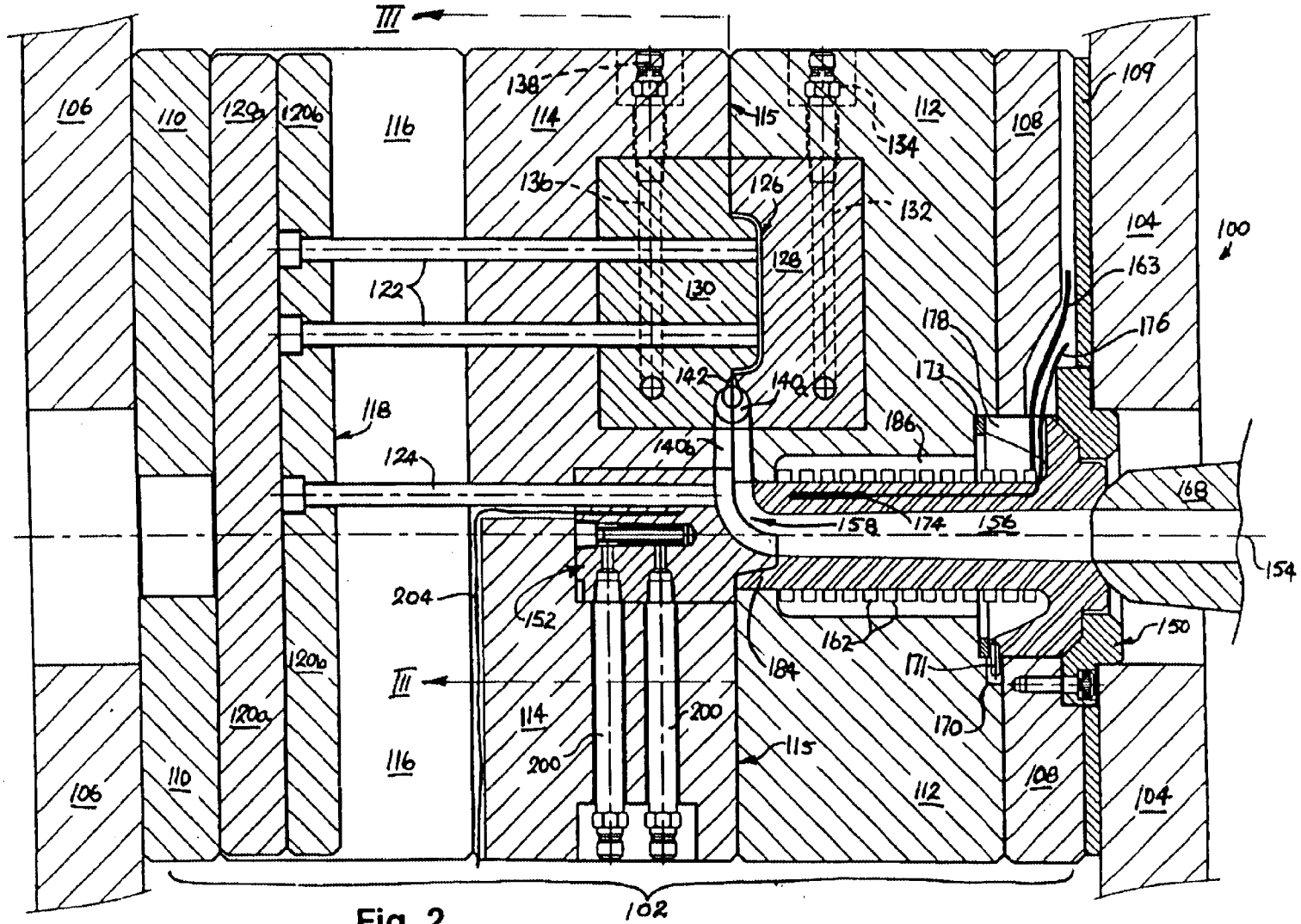
FIG. 2 is a diagrammatic sectional elevation of portion showing the die-set of a typical diecasting machine with sprue inserts formed in accordance with the first example of the present invention.
Figure 4:
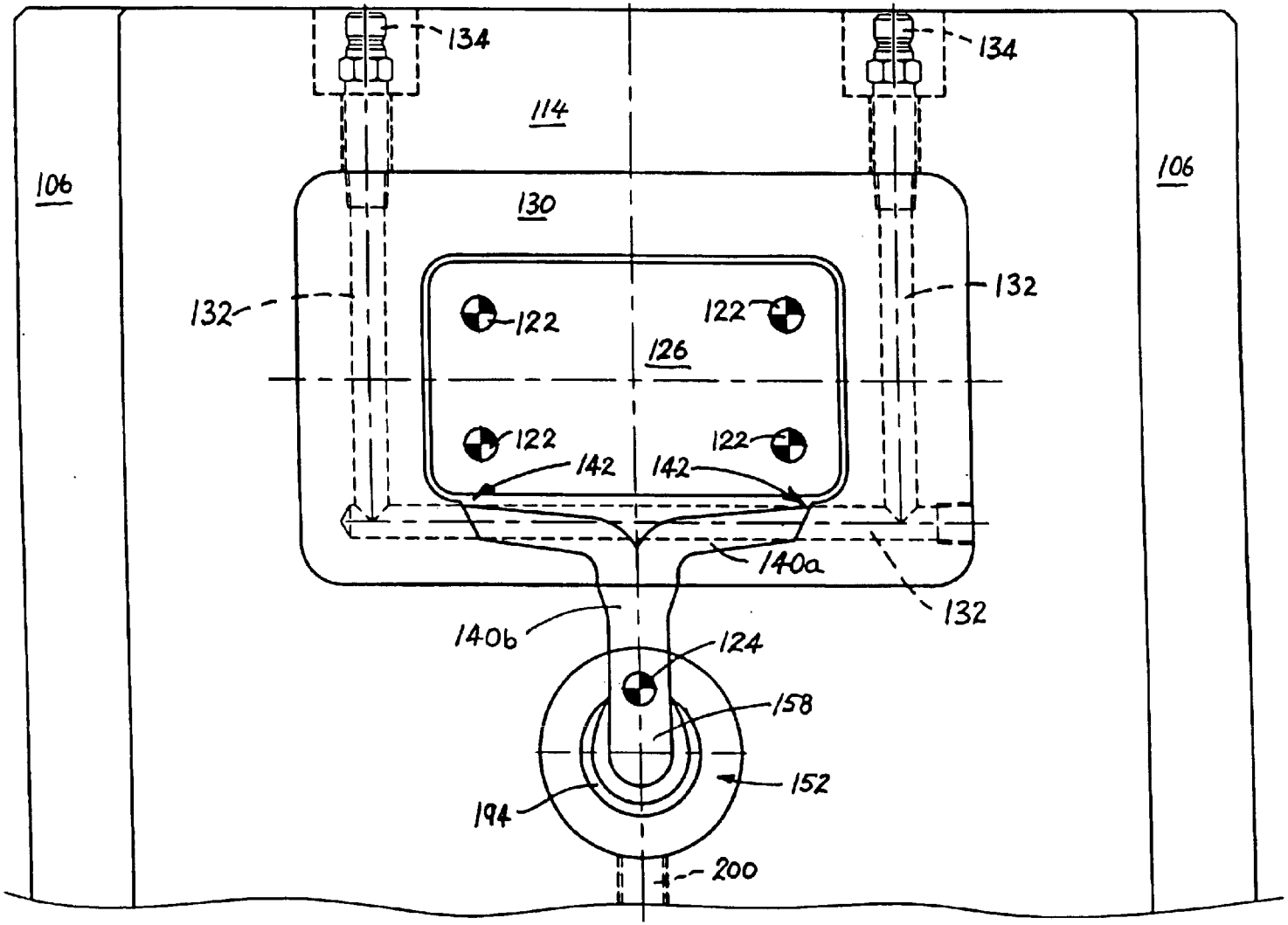
FIG. 4. is an enlarged plan view of portion of the die set of FIG. 2 taken on section line III—III of FIG. 2.

A mould cavity 126 is formed between the faces of a fixed cavity insert 128 located in fixed dieblock 112 and a moving cavity insert 130 located in moving dieblock 114. Fixed cavity insert 128 has a cooling passage 132 (shown in broken lines) connected to fluid couplings 134 in dieblock 112 and moving cavity insert 130 has a cooling passage 136 (shown in broken lines) connected to fluid couplings 138 in dieblock 114. A runner channel 140*a* is formed between die inserts 128 and 130 so as to connect to a runner channel 140*b* formed between dieblocks 112 and 114, runner channel 140*a* being connected to cavity 126 by one or more gates 142. With the die set closed (as shown in FIGS. 2 and 4) a shot of melt is injected along runner channels 140*b* and 140*a* into mould cavity 126 to form product and runner castings. Moving platen 106, backplate 110, bolsters 116, dieblock 114 and die insert 130 are then withdrawn from the fixed portion of the die set while ejector assembly 118 is held stationary. Dieblock 114 therefore slides along pins 122 and 124 to effect the ejection of the product and associated runner castings formed in cavity 126 and runner channels 140*a* and 140*b*.

As so far as described, die set 102 is quite conventional and typical of those widely employed in the hot-chamber diecasting industry.

The hot sprue system of the first example will now be described with particular reference to the enlarged sectional elevation of FIG. 3 and the enlarged plan view of FIG. 4. It comprises a cylindrical tubular sprue body insert 150 mounted in fixed backplate 108 and dieblock 112 and an opposed mating cylindrical sprue tip insert 152 mounted in moving dieblock 114, the inserts 150 and 152 being coaxial and their common axis 154 being orthogonal to interface 115. Sprue body insert 150 has a central tapering sprue channel 156 that narrows in section from its outer end 156*a* to its inner end 156*b*. The inner ends of inserts 150 and 152 mate near parting-line 115 to define a curved transition channel 158 that subtends an angle of 90° and connects sprue channel 156 to runner channels 140*a* and 140*b*, the parting-line of transition channel 158 being indicated at 160. Both the transition channel 158 and runner channels 140*a* and 140*b* preferably narrow gradually toward gates 142.

Sprue body insert 150 has a cylindrical exterior about which is wound an electrical heating element 162 that can be supplied with electrical power via a lead 163. Body insert 150 has a mushroom-like head 164 that provides an outer recess 166, which forms a socket for the heated nozzle 168 (FIG. 2) of diecasting machine 100, and an inner skirt 170 by which insert 150 is located in fixed dieblock 112. A pin 171 which extends radially from skirt 170 and locates in a groove 172 in fixed dieblock 112, and a ring shim 173 which spaces insert 150 from dieblock 112, ensure that the inner end of body insert 150 mates properly with the inner end of tip insert 152 along parting-line 160. A thermocouple temperature sensor 174 is imbedded in body insert 150 and connected via lead 176 to suitable temperature measurement and control equipment (not shown). Heating element lead 164 and sensor lead 176 pass through a slot 178 formed in skirt 170 (see also FIG. 5). Body insert 150 is held in place by a clamping ring 180 that is secured by bolts 182 to fixed backplate 108, the inner end 184 of insert 150 being a snug fit in dieblock 112 so that there is no leakage of melt from transition channel 158 into the space 186 in dieblock 112 that houses sprue insert 150.

Figure 5:
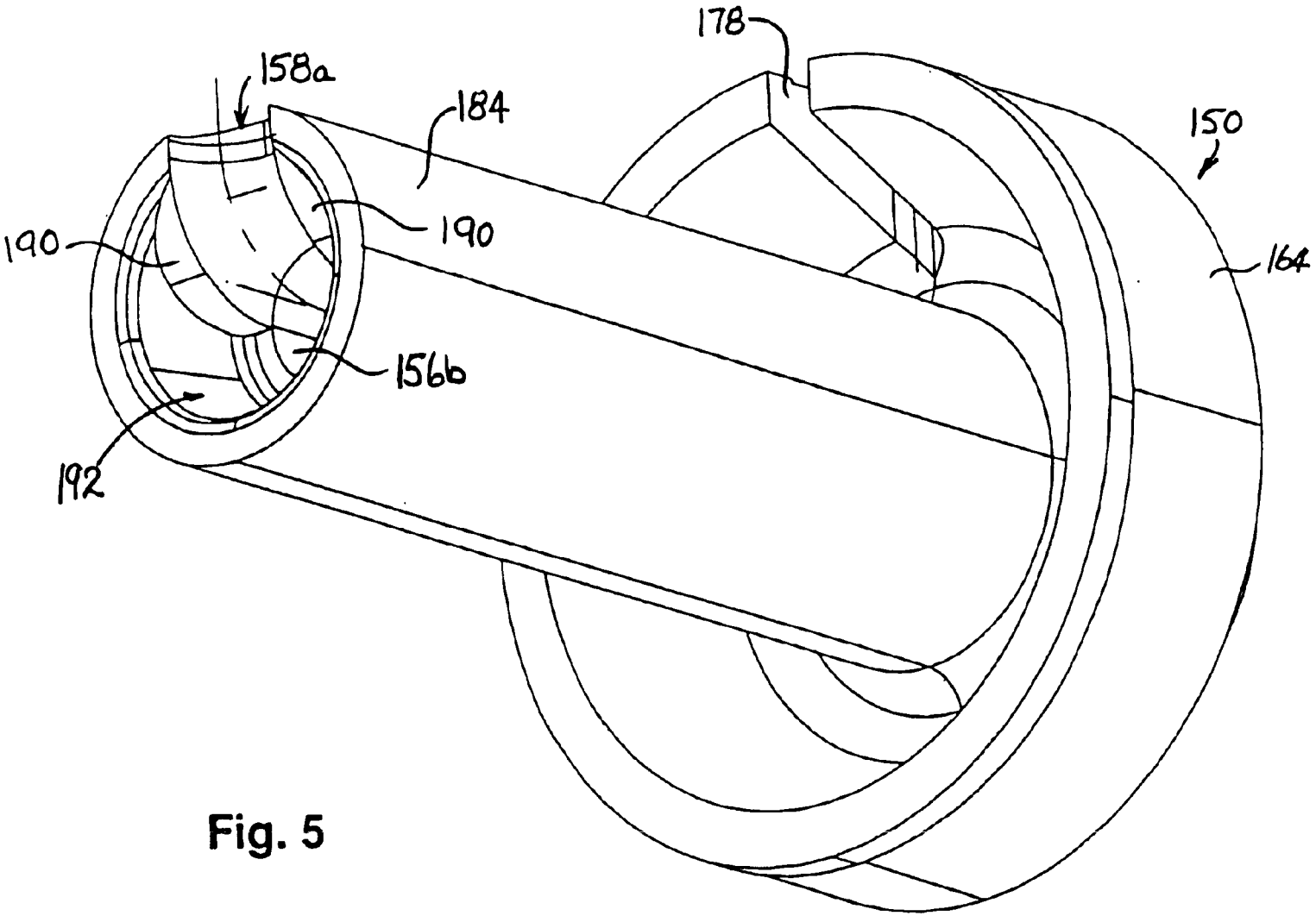
FIG. 5 is a perspective view of the sprue-body insert of FIGS. 2 and 4.

With particular reference to FIG. 5 (which does not show electrical heating element 162 or leads 163 and 176), the inner end 184 of body insert 150 has a part conical socket 192, in one side of which one half—indicated at 158*a*—of curved transition channel 158 (FIG. 4) is formed. A convex-curved shoulder 190 is formed on each side of half channel 158*a* between it and the inner wall of socket 184.

Figure 3:
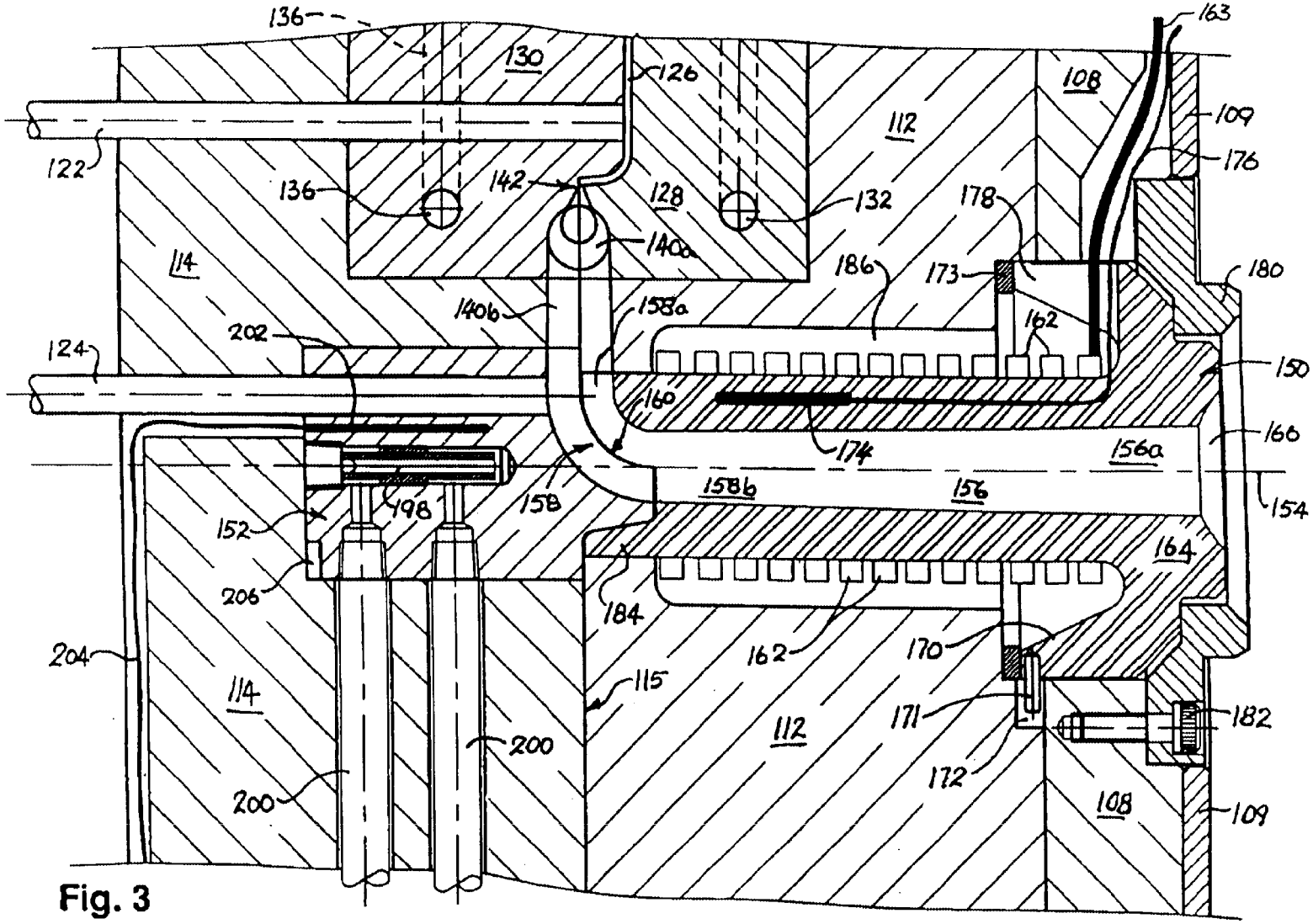
FIG. 3 is an enlarged view of portion of FIG. 2.
Figure 6:
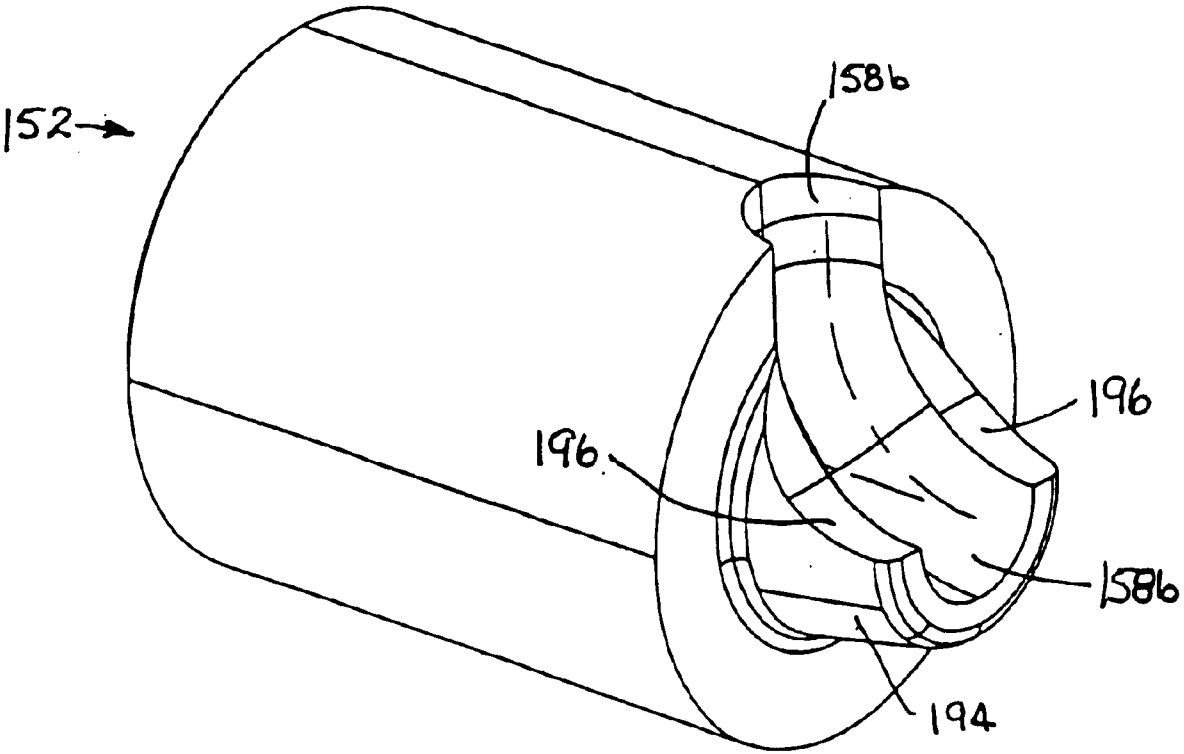
FIG. 6 is a perspective view of the sprue-tip insert of FIGS. 2, 3 and 4.

With reference to FIGS. 3, 4 and 6, sprue tip insert 152 has a part conical plug 194 on its inner end that is shaped to fit snugly into socket 192 of body insert 150. One side of plug 194 is cut away to form a pair of concave-curved shoulders 196 on either side of curved groove 158*b* that forms half of transition channel 158. Shoulders 196 abut with the complementary shoulders 190 on sprue body insert 150. A central baffled cooling passage 198 is formed in insert 152 that connects to cooling fluid passages 200 formed in moving dieblock 114. A temperature sensor 202 is imbedded in insert 152 and its leads 204 are taken through dieblock 114 to a temperature controller (not shown) that regulates the flow of cooling fluid through passages 198 and 200. Finally, sprue tip insert 152 is rotationally located within its socket in dieblock 114 by the use of a key 206 (FIG. 3). [The temperature sensor leads and cooling passage 198 are not shown in FIG. 6.]

Once sprue inserts 150 and 152 have been fitted into their respective dieblocks, the diecasting machine 100 is used in the conventional manner described above, except that the temperatures of the sprue inserts are adjusted to ensure that, at the end of each shot, (i) the melt in the sprue channel 156 remains sufficiently fluid to quickly drain back into nozzle 168 and (ii) the runner freeze-point occurs in transition channel 158. As the moving components of die set 102 are withdrawn from the fixed components after each shot, the product is ejected from cavity 126 by ejector pins 122 and the runner and transition castings are ejected from the runner and transition channels 140 and 158 with the assistance of ejector pin 124.

Figure 7:
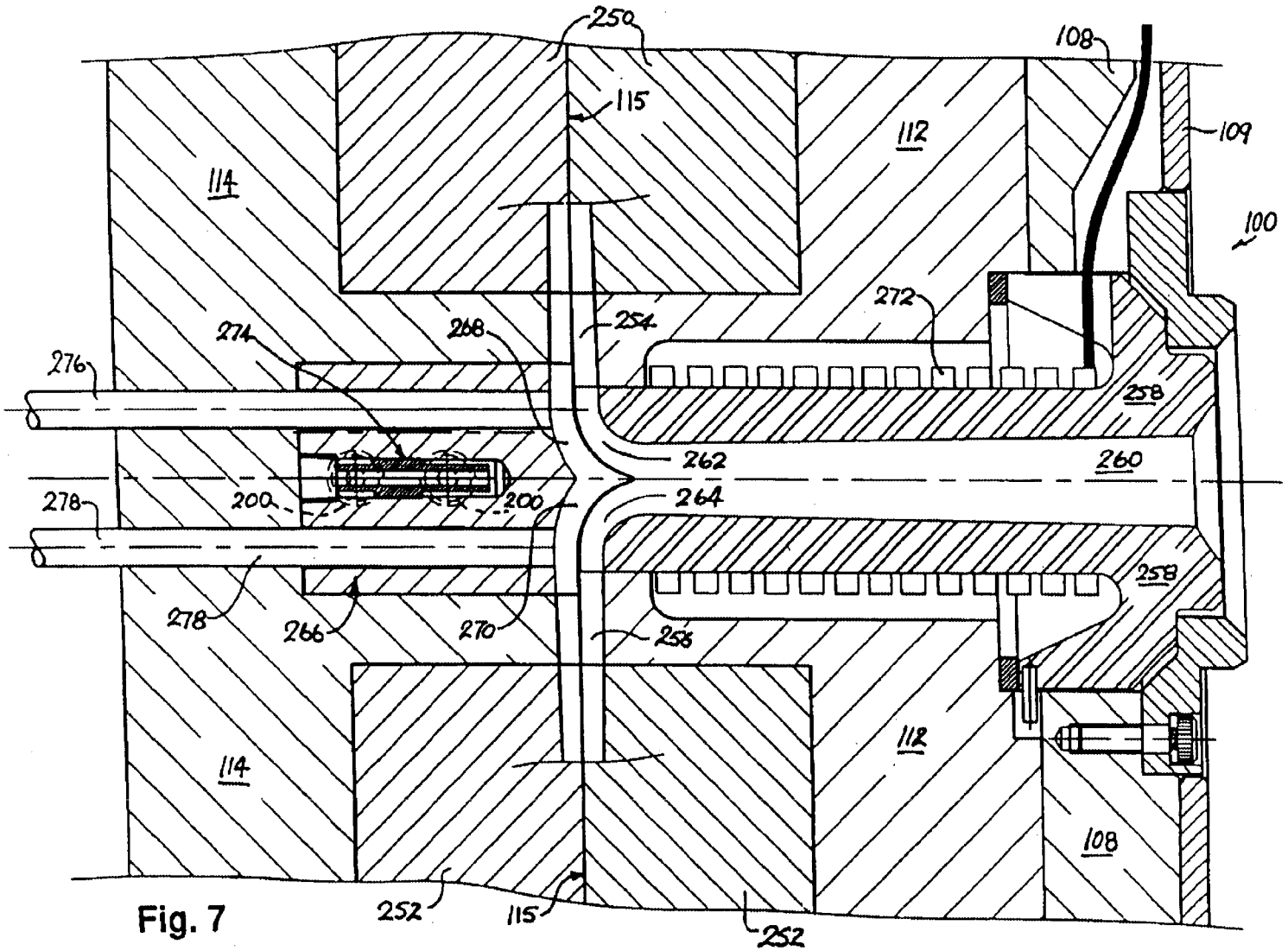
FIG. 7 is a sectional elevation of a die-set having a sprue and a sprue-tip insert formed so as to feed two opposed runner channels.

The second example of a hot sprue system formed in accordance with the present invention is shown in FIG. 7. As in the first example, the die set includes a fixed back plate 108, fixed dieblock 112 and moving dieblock 114. In this example, however, two pairs of die inserts 250 and 252 are employed, fed by respective runner channels 254 and 256. The sprue body insert 258 in this example defines a central tapering sprue channel 260, as before. It is formed, located and clamped as in the first example, except that its inner end is bifurcated to form a pair of opposed curved half transition channels 262 and 264 that connect with respective runner channels 254 and 256. Similarly, the inner end of sprue tip insert 266 is bifurcated to form two opposed curved half transition channels 268 and 270 that connect with runners 254 and 256, mating with the corresponding half transition channels 262 and 264 of sprue body insert 258. As before, body insert 258 has a heating element 272 and tip insert 266 has a cooling passage 274. However, in this example, two ejector pins 276 and 278 are used to ensure that casting formed in each transition channel is positively ejected when the dies part after each shot.

It will be appreciated from the above description that this sprue-less diecasting method can be easily introduced and operated with standard hot-chamber diecasting machines using only the normal skills of a tool-maker or machine-setter/operator. Only the simplest of adjustment and set-up procedures are required from a machine-setter. Yet, the economies and benefits of spruce-less diecasting are substantial.

However, as previously indicated, many variations and changes can be effected without departing from the scope of the present invention. Though considered advantageous, it is not essential to taper the sprue and transition channels as described in these examples. Satisfactory results can obtained using non-tapering channels. It will also be appreciated that there are many ways known in the art whereby the sprue inserts can be correctly mounted and positioned in their respective dieblocks. The methods disclosed in the examples may not suit all die sets or toolmaking techniques and can be readily varied. For example, shims may be used with the sprue tip insert rather than—or in addition to—the sprue body insert in order to effect adjustment. Or, given appropriate machining in the first place, no shimming may be needed. Similarly, the method chosen to fit and clamp the sprue body in place may also be varied as convenient. It is envisaged that thermal insulating material can be formed around the heating element of the sprue body to minimize heat loss to the fixed dieblock. Indeed, the sprue tip insert may also be insulated to minimize heat gain from the moving dieblock. Alternatively, the sprue tip insert need not be insulated or temperature controlled as the temperature the moving dieblock can be such as to hold the tip insert at a temperature which ensures freeze-off in the transition channel.

What is claimed is:

1. A sprue insert-set for use in defining at least a portion of the melt flow path in a high-pressure, hot-chamber diecasting apparatus between an injection nozzle and a runner channel formed between the parting faces of a fixed and a moving die, the sprue insert-set comprising:

a tubular sprue body insert for mounting in the fixed die and a sprue tip insert for mounting in the moving die in opposed relation to said body insert; said body insert having a sprue channel extending therethrough, an outer end defining an inlet opening to the sprue channel, an inner end defining an outlet opening to the sprue channel heating means for heating said sprue channel, a first curved groove formed in said inner end of said body insert leading from said outlet opening of the sprue channel; and said tip insert having:

an inner end adapted to mate with the inner end of the body insert, a second curved groove formed in the inner end of the tip insert of complementary form to said first curved groove in the inner end of the body insert such that, when the inner end of the tip insert is mated with the inner end of the body insert, said first and second grooves cooperate to form a curved transition channel for connecting the outlet of the sprue channel to the runner channel when the body insert is mounted in the fixed die, the tip insert is mounted in the moving die when the dies are closed, and cooling means for cooling said second curved groove.

2. A sprue insert-set according to claim 1 wherein:

the sprue channel and the curved transition channel taper uniformly so that the velocity of the melt will increase uniformly as it travels from the inlet opening of the sprue channel to the runner channel when the insert-set is in use and the dies are closed.

3. A sprue insert-set according to claim 1 wherein said curved transition channel subtends an angle of substantially 90° when the inner end of the body insert is mated with the inner end of the tip insert.

4. A sprue insert-set according to claim 1 wherein the body insert includes temperature sensor means for use in controlling the temperature of the body insert when the insert-set is in use.

5. A sprue insert-set according to claim 1 wherein the sprue body insert includes thermal insulation encompassing the heater means so as to mitigate the loss of heat from the sprue insert to the fixed die when the sprue insert-set is in use.

6. A sprue insert-set according to claim 1 wherein said tip insert includes temperature sensor means for controlling the temperature of the tip insert when the insert-set is in use.

7. A sprue insert-set according to claim 1 wherein the body insert is of generally cylindrical form and has a longitudinal axis, the tip insert is of generally cylindrical form and has a longitudinal axis, mating plug and socket means are provided on inner ends of the body and tip inserts so that said body insert and said tip insert are positively located coaxially with respect to one another when their respective inner ends are mated to form said transition channel.

* * * * *